US005762528A

United States Patent [19]

Ninomiya

[11] Patent Number: 5,762,528

[45] Date of Patent: Jun. 9, 1998

[54] ALIGNMENT MEASUREMENT APPARATUS AND METHOD FOR USING THE SAME IN FORMING PHOSPHOR SCREEN IN COLOR CATHODE-RAY TUBE

[75] Inventor: Takafumi Ninomiya, Shiga, Japan

[73] Assignee: NEC Corporation, Tokyo, Japan

[21] Appl. No.: 623,027

[22] Filed: Mar. 28, 1996

[30] Foreign Application Priority Data

Mar. 28, 1995 [JP] Japan ..... 7-069501

[51] Int. Cl.[6] ..... H01J 9/42

[52] U.S. Cl. ..... 445/63; 445/3

[58] Field of Search ..... 445/63, 3

[56] References Cited

U.S. PATENT DOCUMENTS 4,584,481 4/1986 Matey ..... 445/63
5,685,760 11/1997 Han ..... 445/63

FOREIGN PATENT DOCUMENTS 1-10543 1/1989 Japan ..... 445/63
1-241735 9/1989 Japan ..... 445/63
1-165410 11/1989 Japan .
5-198262 8/1993 Japan ..... 445/64

*Primary Examiner*—Gary F. Paumen
*Assistant Examiner*—Jeffrey T. Knapp
*Attorney, Agent, or Firm*—Sughrue, Mion, Zinn, Macpeak & Seas, PLLC

[57] ABSTRACT

An alignment measurement apparatus is used for measuring an exposure pattern during an exposure operation for forming phosphor layers on a panel surface of a color cathode-ray tube, and includes an image sensor, an image spatial filter, and an image processing equipment. The image sensor photographs the exposure pattern on the panel surface to which an illuminating device is provided, the image spatial filter makes 3-color phosphor dots brighter and clearer, and the image processing equipment calculates and outputs a value of deviation between the exposure pattern of the 3-color phosphors and a reference exposure pattern. Any blurred exposure pattern is made bright and clear by the image spatial filter so that the degree of any deviation between the black matrix hole and the center of the exposure pattern is measured at a high precision.

6 Claims, 4 Drawing Sheets

ALIGNMENT MEASUREMENT APPARATUS AND METHOD FOR USING THE SAME IN FORMING PHOSPHOR SCREEN IN COLOR CATHODE-RAY TUBE

BACKGROUND OF THE INVENTION (1) Field of the Invention

The present invention relates to an alignment measurement apparatus and a method for using the same for use during an exposure process for forming a phosphor screen in a color cathode-ray tube, and more particularly to an alignment measurement apparatus and a method for using the same with which it is possible to make a precise measurement of an exposure pattern of 3-color phosphor dots.

(2) Description of the Related Art

Generally, in a color cathode-ray tube of a shadow mask type, a black matrix film composed of a light absorbing material layer is formed on an inside surface of a panel facing a shadow mask disposed inside the panel, and fine dot-like phosphor layers which respectively emit red, green and blue colors are formed at opening portions of the black matrix film. The phosphor layers are generally formed sequentially for one color at a time by a precision photo exposure method utilizing a photosensitive material. During the formation of each of the phosphor layers, it is required to make an advance correction of the location of the panel by measuring in advance the degree of any deviation between the exposure patterns and the black matrix holes caused by an exposure apparatus, and this makes it necessary to use an alignment measurement apparatus.

Conventionally, the alignment measurement has been carried out by using an exposure apparatus as shown in FIG. 1. The exposure apparatus is constituted by a table 2 which is finely adjustable and which carries and positions reference panel 1, a light source 3 disposed under the table 2, and a correcting lens 4 and a light adjusting filter 5 disposed between the table 2 and the light source 3. The table 2 carries the test reference panel 1 coated with a green phosphor having good emission properties with respect to ultraviolet rays from a mercury lamp as the light source 3 for the exposure, whereby the exposure patterns at a peripheral portion of an outside surface of the reference panel 1 are photographed with magnification by a CCD camera 6, the black matrix holes and the exposure pattern images are observed by a picture image monitor 8, the reference panel 1 is moved three dimensionally by the table 2, and the center of each black matrix holes and the center of the emitted light of each exposure pattern are brought into coincidence with each other. From the degree of this movement, the degree of deviation is measured and the alignment measurement is carried out.

Normally, as an apparatus for measuring black matrix holes of a color cathode-ray tube of the above kind, it is arranged such that, for purposes of eliminating a measurement error caused by external light 9, an external light shielding plate 7 is provided to cover a periphery of the light receiving surface of a measuring sensor (CCD camera 6 in FIG. 1) as disclosed, for example, in Japanese Utility Model Kokai Publication No. Hei 1-165410 .

However, since the excitation emission of phosphor by the ultraviolet light, as used for a light source for the exposure, is very weak, and the light transmitted through the phosphor layer is small and is scattered, the image of the exposure pattern is of low luminosity and is blurred as shown in FIG. 2. Thus, where the external light shielding plate as described above covers a portion of the light receiving surface to make the measuring environment dark, the black matrix holes cannot be observed clearly, so that the alignment measurement precision may be at a maximum on the order of 10 μm. However, recently, a high precision color cathode tube has been manufactured with the diameter of the black matrix hole reduced to smaller than 90 μm, which requires the measuring precision to be within 2 μm but this requirement has not been met in the past.

A further problem in the above prior art example is that, since the alignment measurement is done visually and manually, it takes a long time for the measuring operation.

SUMMARY OF THE INVENTION

An object of the present invention, therefore, is to overcome the problems existing in the prior art, and to provide an alignment measurement apparatus with which the blurred exposure pattern is made bright and clear by the image spatial filter whereby the degree of any deviation between the black matrix hole and the center of the exposure pattern is automatically measured at a high precision, and to provide a method for using the alignment measurement apparatus whereby the adjustment and evaluation of the exposure apparatus can be made effectively and efficiently.

According to one aspect of the invention, there is provided an alignment measurement apparatus which is used during an exposure operation for forming a phosphor screen composed of 3-color phosphor dots on a panel surface of a color cathode-ray tube and which is for measuring exposure pattern on the panel surface, the alignment measurement apparatus comprising:

- an image sensor which photographs the exposure pattern on the panel surface;
- an image spatial filter which makes the 3-color phosphor dots brighter and clearer; and
- an image processing equipment which calculates and outputs a value of deviation between the exposure pattern of the 3-color phosphor dots and a reference exposure pattern.

According to another aspect of the invention, there is provided a method for using an alignment measurement apparatus which comprises an image sensor which photographs exposure patterns on a panel surface; an image spatial filter which makes 3-color phosphor dots brighter and clearer; and an image processing equipment which calculates and outputs a value of deviation between the exposure pattern of the 3-color phosphor dots and a reference exposure pattern, the method comprises the steps of:

- measuring a value of deviation between the exposure pattern of the 3-color phosphor dots and a reference exposure pattern, and
- correcting a panel position adjusting means of an exposure apparatus during an exposure operation for respective 3-color phosphor dots.

By employing the alignment measurement apparatus according to the invention, even when the exposure pattern image is of low luminosity and is blurred or the measurement environment is dark, the exposure pattern luminosity can be made uniform and clear by the image spatial filter thus enabling the measurement precision of the alignment to be within 2 μm. Also, when an LED (light emission diode) lamp is employed as an illuminating means, the contour of the black matrix hole can be observed clearly, and can be distinguished from the light emission color of the exposure pattern. Further, by using a CCD camera having a slow shutter speed for the image sensor, the measured quantity of light can be increased thereby increasing sensitivity. Also, by arranging that the image sensor is equipped with an auto focus mechanism, the measuring time can be reduced.

Also, since the precise alignment measurement can be made, by using this alignment measurement apparatus, the work which is required for the evaluation of the correcting lens or the evaluation of the reference panel of the exposure apparatus can be easily carried out by using an ordinary exposure apparatus.

Furthermore, since the image processing equipment has an algorithm function for making the center of the region surrounded by the equi-luminescence line of the exposure pattern of the phosphor dots as the center of each of the exposure patterns of the phosphor dots, the luminosity center of the phosphor dots can be measured precisely. Also, since the image processing equipment has a function of outputting a correcting value of the panel position adjusting means of the exposure apparatus with this value being calculated from the degree of deviation between the center of each of the exposure patterns of the phosphor dots and the center of each of the reference dots at the image surface center area and periphery of the image processing equipment so that, based on this output, the panel positioning means can be automatically adjusted, or the correcting adjustment can be made accurately even by manual operation.

Also, because of the high accuracy alignment measurement of the exposure pattern, it enables the prevention of the occurrence of color deviation by measuring the degree of deviation in individual exposure patterns of the 3-color phosphor dots from the reference exposure pattern, and correcting the panel position adjusting means of the exposure apparatuses during the respective exposure operations for the 3-color phosphor dots. Further, by making precise measurement of the degree of deviation between the exposure patterns of the 3-color phosphor dots on the panel surface and the reference exposure pattern on individual correcting lenses of the exposure apparatuses, it is made possible to make evaluation and reduce variation in the finished states of the correcting lenses of the exposure apparatuses in which an error tolerance is small. Also, by making precise measurement of the degree of deviation between the exposure patterns of the 3-color phosphor dots on the reference panel surface and the reference exposure pattern on individual reference panels, it is made possible to make evaluation for the reference panels in which an error tolerance of the matrix holes with respect to the phosphor dots is minute.

BRIEF DESCRIPTION OF THE DRAWINGS

The file of this patent contains two drawings executed in color. Copies of this patent with color drawings will be provided by the Patent and Trademark Office upon request and payment of the necessary fee.

The above and other objects, features and advantages of the present invention will be apparent from the following description of preferred embodiments of the invention explained with reference to the accompanying drawings, in which.

PREFERRED EMBODIMENTS OF THE INVENTION

Figure 1:
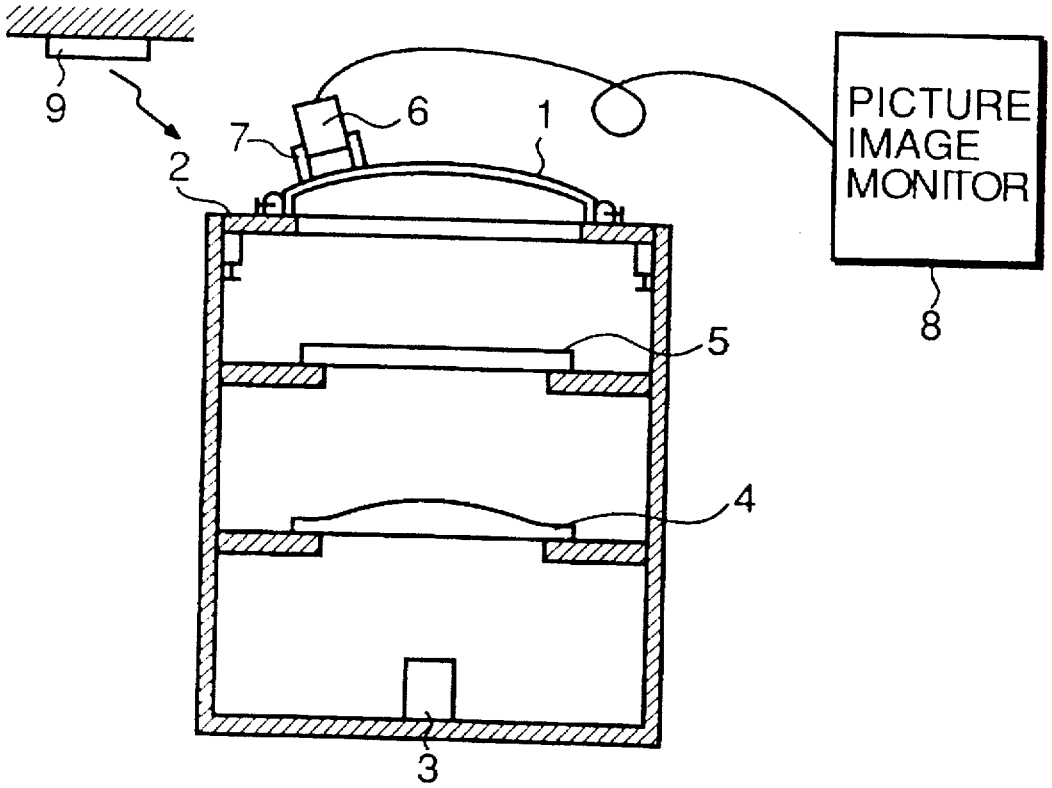
Fig. 1 PRIOR ART
FIG. 1 is a sectional view showing a prior art alignment measurement apparatus.

Now, an exposure apparatus of a first embodiment according to the invention is explained with reference to the drawings. Throughout the explanation, the same or similar reference numerals and symbols refer to the same or similar elements in all figures of the drawings.

Figure 3:
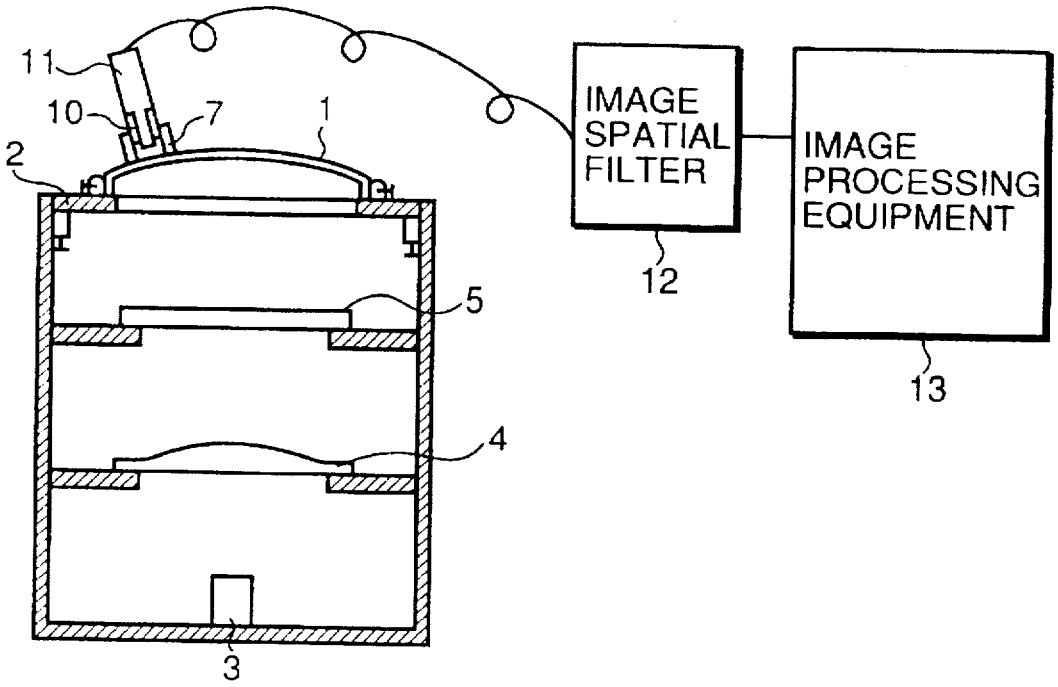
FIG. 3 is a sectional view showing an alignment measurement apparatus of a first embodiment according to the invention.

As shown in FIG. 3, the alignment measurement apparatus is constituted, similarly as the prior art example, by a table 2 which is finely adjustable and which carries and positions reference panel 1 coated with a green phosphor; a light source 3 disposed under the table 2; and a correcting lens 4 and a light adjusting filter 5 disposed between the table 2 and the light source 3. The apparatus further includes an image sensor 11 which is constituted by a CCD camera provided with a plurality of LED lamps 10 for illumination and which measures the exposure pattern on an outer surface of the reference panel 1; an image spatial filter 12 which grades the received image into a plurality of tones depending on the levels of brightness for making uniform the brightness of the phosphor dots of the exposure pattern photographed by the image sensor 11; and an image processing equipment 13 which has an algorithm function of calculating the degree of deviation between the black matrix holes and the exposure patterns by making the center of the region surrounded by the equi-luminescence line of the exposure pattern of the phosphor dots as the center of each of the exposure patterns of the phosphor dots and, based on the degree of deviation, calculates and output the correcting value of the panel position adjusting means of the exposure apparatus.

Figure 2:
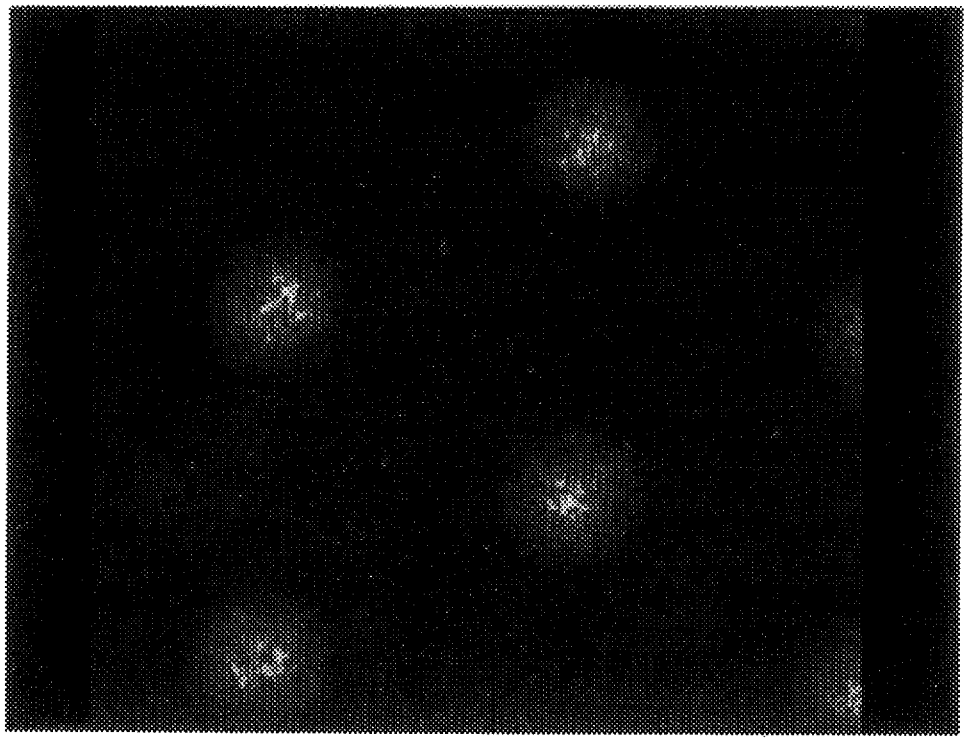
FIG. 2 PRIOR ART
FIG. 2 is a picture showing the exposure pattern detected by the prior art alignment measurement apparatus.
Figure 4:
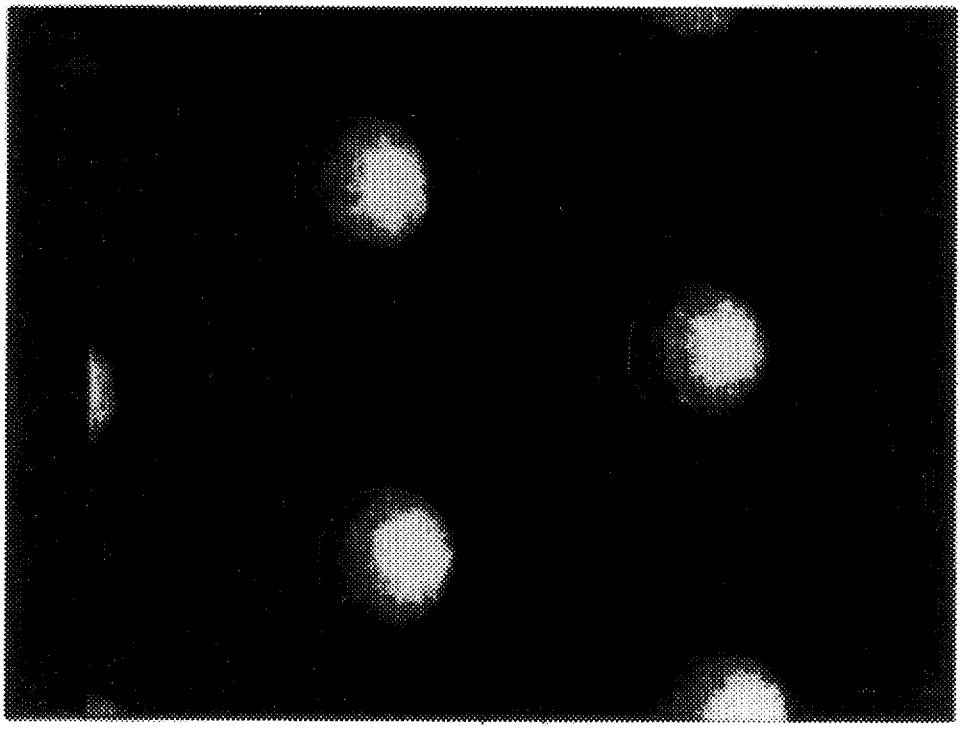
FIG. 4 is a picture showing the exposure pattern detected by the alignment measurement apparatus of the first embodiment according to the invention.

An example of the detected exposure pattern by the alignment measurement apparatus of this first embodiment is shown by a picture in FIG. 2. As shown therein, since the black matrix holes to which the LED light is reflected and the exposure patterns of the phosphor dots which is formed by the transmitted light from the light source 3 have the brightness which has been made uniform by the image spatial filter, and also since the image processing employs an algorithm function of making the center of the region surrounded by the equi-luminescence line of the exposure pattern of the phosphor dots as the center of each of the exposure patterns of the phosphor dots, so that the degrees of deviation in the respective center positions can be precisely obtained and the measurement error can be suppressed to within 2 μm.

The correcting value which is predetermined against the degree of deviation is outputted in each exposure device so that, if the panel positioning mechanism of the table 2 is finely adjusted and corrected by the correcting value either automatically or manually, the exposure operation can be carried out with the alignment being precise.

Figure 5:
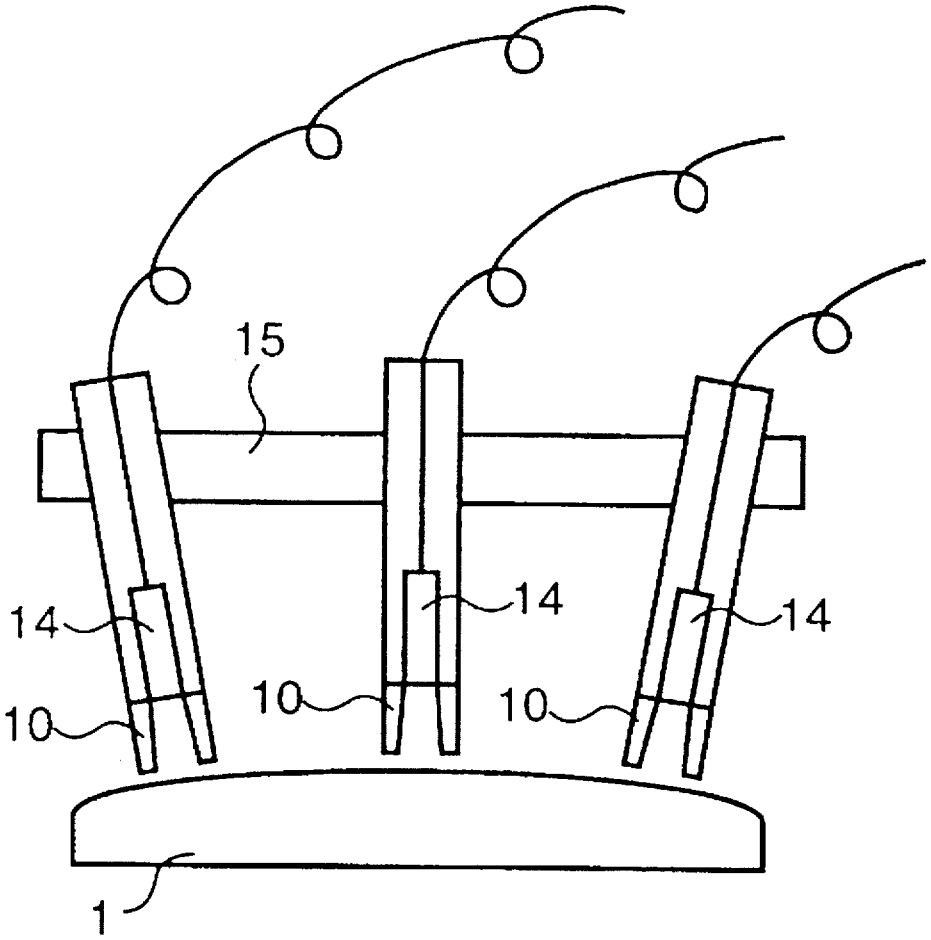
FIG. 5 is a front view showing a portion of a feature element of an alignment measurement apparatus of a second embodiment according to the invention.

FIG. 5 shows an alignment measurement apparatus of a second embodiment according to the invention. In this apparatus, an image sensor holding mechanism 15 is provided so that the image sensor 14 constituted by the CCD camera having an auto-focus mechanism is allowed to be automatically moved to and positioned at a predetermined location of an outer surface of the reference panel 1. Other structural arrangements in this embodiment are the same as those in the first embodiment. In this embodiment, the alignment measurement is automatic.

The third embodiment of the invention relates to a method of using the alignment measurement apparatus explained above. The method is used for making evaluation of a correcting lens. The correcting lens 4 shown in FIG. 3 is replaced by a correcting lens to be evaluated and, by the alignment measurement apparatus according to the invention, the degree of deviation between the exposure patterns of the 3-color phosphor dots on the surface of the panel and the reference exposure patterns are measured. Then, the evaluation is made on the state of the measured correcting lens as to whether the resultant degree of deviation is within the range of the tolerable error. By using the measured correcting lens whose deviation is within the tolerable range, it can be ensured to reduce the variation on individual apparatuses.

Similarly, the correcting lens may be replaced by a reference panel and, when the degree of deviation between the exposure pattern of the 3-color phosphor dots on the surface of the reference panel and the reference exposure patterns are measured, it is made possible, because of a high precision measurement, to evaluate the reference panel for a minute tolerable error.

The above embodiments have been explained for the examples wherein a green phosphor, but of course the invention is not limited to these embodiments as, for example, the reference panel may be formed by using phosphor which easily emits light by an ultraviolet exposure light source, in which case the brightness of the exposure pattern can be enhanced, and only the diffused light from the phosphor dots, without the transmitted light emitted from the light source being picked up, can be used, and further a high precision alignment measurement can be achieved.

While the invention has been described in its preferred embodiments, it is to be understood that the words which have been used are words of description rather than limitation and that changes within the purview of the appended claims may be made without departing from the true scope of the invention as defined by the claims.

What is claimed is:

1. An alignment measurement apparatus which is used during an exposure operation for forming a phosphor screen composed of 3-color phosphor dots on a panel surface of a color cathode-ray tube and which is for measuring exposure pattern on said panel surface, said alignment measurement apparatus comprising:

an image sensor which photographs said exposure pattern on said panel surface;

an image spatial filter which makes said 3-color phosphor dots brighter and clearer; and an image processing equipment which calculates and outputs a value of deviation between said exposure pattern of said 3-color phosphor dots and a reference exposure pattern.

2. An alignment measurement apparatus according to claim 1, which further comprises an illuminating means composed of a plurality LED lamps provided at a periphery of said image sensor.

3. An alignment measurement apparatus according to claim 1, in which said image sensor comprises a CCD camera having a slow shutter.

4. An alignment measurement apparatus according to claim 1, in which said image sensor is provided with an auto-focus mechanism.

5. An alignment measurement apparatus according to claim 1, in which said image processing equipment is arranged such that it has an algorithm function for calculating a center of a region surrounded by an equi-luminescence line of said exposure pattern of said phosphor dots as a center of each of the exposure patterns of said phosphor dots.

6. An alignment measurement apparatus according to claim 1, in which said image processing equipment is arranged such that it has a function of calculating and outputting a correcting value of a position adjusting means for the panel surface of the exposure apparatus based on a value of deviation between a center of each of the exposure patterns of the phosphor dots and a center of each of reference dots at an image surface center area and a peripheral portion.

* * * * *